US006714870B1

(12) United States Patent
Weston et al.

(10) Patent No.: US 6,714,870 B1
(45) Date of Patent: Mar. 30, 2004

(54) METHOD OF AND APPARATUS FOR DETERMINING THE PATH OF A WELL BORE UNDER DRILLING CONDITIONS

(75) Inventors: John Lionel Weston, Chedzoy (GB); Dieter Goetz, Emmendingen-Windenreute (DE); Gerard Hohner, Munich (DE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/070,713

(22) PCT Filed: Jun. 1, 2000

(86) PCT No.: PCT/GB00/02097

§ 371 (c)(1),
(2), (4) Date: Mar. 8, 2002

(87) PCT Pub. No.: WO01/29372

PCT Pub. Date: Apr. 26, 2001

(30) Foreign Application Priority Data

Oct. 19, 1999 (DE) ..... 199 50 340

(51) Int. Cl.[7] ..... G01V 3/18
(52) U.S. Cl. ..... 702/9; 702/6
(58) Field of Search ..... 702/9, 6; 367/82; 33/304

(56) References Cited

U.S. PATENT DOCUMENTS

| | | | | | |
|---|---|---|---|---|---|
| 4,472,884 | A | * | 9/1984 | Engebretson | 33/304 |
| 4,945,775 | A | * | 8/1990 | Adams et al. | 73/865.8 |
| 4,987,684 | A | * | 1/1991 | Andreas et al. | 33/304 |
| 5,657,547 | A | * | 8/1997 | Uttecht et al. | 33/304 |
| 6,065,219 | A | * | 5/2000 | Murphey et al. | 33/544 |
| 6,145,378 | A | * | 11/2000 | McRobbie et al. | 73/490 |
| 6,267,185 | B1 | * | 7/2001 | Mougel et al. | 175/57 |
| 6,347,282 | B2 | * | 2/2002 | Estes et al. | 702/6 |
| 6,453,239 | B1 | * | 9/2002 | Shirasaka et al. | 701/220 |

* cited by examiner

*Primary Examiner*—Marc S. Hoff
*Assistant Examiner*—Anthony Gutierrez
(74) *Attorney, Agent, or Firm*—Conley Rose, P.C.

(57) ABSTRACT

Apparatus for determining the path of a well bore during drilling, comprises an inertial measurement unit (12) for providing data from which position, velocity and attitude can be derived, the measurement unit comprising a plurality of inertial sensors mounted on a platform assembly which is, in use, disposed within a drill string (6), and a drive unit (5) for rotating the platform assembly so as to control the rate of angular displacement of the platform assembly with respect to an Earth fixed reference frame.

15 Claims, 5 Drawing Sheets

METHOD OF AND APPARATUS FOR DETERMINING THE PATH OF A WELL BORE UNDER DRILLING CONDITIONS

BACKGROUND OF THE INVENTION

This invention relates to a method of and apparatus for determining the path of a well bore under drilling conditions.

To facilitate the extraction of oil and gas from the Earth, well bores are drilled by rotating a drill bit attached to the end of a drilling assembly, commonly referred to as a 'bottom hole assembly'. The path of the well bore must be precisely controlled so as to reach the required 'target', the underground reservoir containing the hydrocarbons to be extracted, as efficiently as possible. At the same time, it is essential to ensure that the path of a new well bore is maintained at a safe distance and avoids existing well bores in the same oil field. To achieve these objectives, it is necessary to control accurately the path of the well bore whilst it is being drilled. This can be achieved by various means using vector measurements of the Earth's magnetic and gravity fields derived using magnetic and acceleration sensors respectively to determine the inclination, azimuth direction of the well and tool face angle, or alternatively, by using acceleration sensors and gyroscopes capable of sensing components of Earth's rate in order to derive the direction of the well path. The vector measurements in combination with depth information, derived from the well pipe tally for instance, are used to provide a measure of the well path on a 'continuous' basis throughout the drilling process.

U.S. Pat. No. 4,812,977 discloses a so-called strapdown inertial navigation system. The device utilises gyroscopes and accelerometers together with the necessary sensor drive electronics and signal processing capability. The system is capable of providing measurements of the orientation and/or position of the inertial system as the drilling process proceeds. These data define the instantaneous inclination and azimuth direction of the well path with respect to an Earth fixed coordinate frame of reference and/or the coordinate position of the device within the well bore with respect to the designated reference frame; this is usually defined in terms of the north, east and vertical position, or in polar coordinates as latitude, departure and depth. The inertial sensors are fixed rigidly to a support unit commonly and herein referred to as a platform. The platform may in turn be attached to the drill string assembly rigidly or via anti-vibration mounts.

BRIEF DESCRIPTION OF THE PREFERRED EMBODIMENTS

The device which is the subject of this patent application seeks to extend the use of strapdown technology to facilitate its application for a broader range of well drilling applications; in particular, but not exclusively, to allow a strapdown inertial navigation system to be used to provide meaningful survey data whilst implementing the drilling process known as rotary drilling, in which the drill bit is driven from the surface causing the complete tool string to rotate at the required drill speed in order for the rotary motion to be transmitted to the drill bit at the bottom of the well. In the event that a strapdown inertial system were to be used in such an application, the drill string rotation rate may well exceed the measurement range of the gyroscope and the gyroscope scale factor error would give rise to an unacceptably large measurement offset during a high speed drilling operation.

According to a first aspect of the invention there is provided apparatus for determining the path of a well bore during drilling, comprising an inertial measurement unit for providing data representative of position, velocity and attitude, the measurement unit comprising a plurality of inertial sensors mounted on a platform assembly which is, in use, disposed within a drill string, and a drive unit for rotating the platform assembly so as to control the rate of angular displacement of the platform assembly with respect to an Earth fixed reference frame.

The term "Earth fixed reference frame" typically means a Cartesian co-ordinate frame the axes of which are coincident with the directions of true north, east and the local gravity vector.

Preferably, the inertial sensors comprise accelerometers and gyroscopes and the inertial measurement unit further includes means for integrating output signals of the accelerometers once to provide information representative of velocity and twice to provide information representative of position, and means responsive to output signals of the gyroscopes for resolving the accelerometer outputs into an Earth fixed reference frame and to generate estimates of inclination azimuth and tool face angles.

Other preferred and/or optional features of the first aspect of the invention are set forth in claims 3 to 6.

According to a second aspect of the invention there is provided a method of determining the path of a well bore during rotary drilling using the apparatus according to the first aspect and rotating the platform assembly to cause the platform assembly to remain stationary, or near stationary, in angular terms with respect to an Earth fixed reference frame.

According to a third aspect of the invention there is provided a method of determining the path of a well bore during rotary or mud motor drilling using the apparatus according to the first aspect and rotating the platform assembly at a fixed angular rate with respect to an Earth fixed reference frame.

According to a fourth aspect of the invention, there is provided a method of using apparatus according to the first aspect of the invention, wherein the platform assembly is rotated by the drive unit at a slow angular rate relative to an Earth fixed reference frame to cancel out the effects of residual bias errors in the gyroscopes.

According to a fifth aspect of the invention, there is provided a method of using apparatus according to the first aspect of the invention, wherein the drive unit is used to decouple and maintain control of rotation of the platform assembly relative to tool string rotation to reduce the effects of scale factor errors in the gyroscopes.

The invention is particularly applicable to rotary drilling, but the system described herein could also be used to provide well trajectory data when operated during the drilling process known as mud-motor drilling. In this case, the drill bit is driven by the circulation of drilling fluid or 'mud' which is pumped from surface down the drill pipe to the motor at the well, before returning to the surface via the annulus formed between the drill pipe and the wall of the well bore. Energy is imparted to the drill bit via an impeller or mono device causing the drill bit to rotate. In this method of drilling, the drill string rotation remains nominally at zero throughout the process. However, there are still benefits to be obtained in terms of system accuracy and ruggedness through installing the inertial measurement unit on a stable platform assembly as described above.

The invention will now be more particularly described, by way of example, with reference to the accompanying drawings, in which:

DETAILED DESCRIPTION OF THE PREFERRED EMBODIMENTS

Bore hole drilling is normally achieved by either rotary drilling (FIG. 1*a*) or by mud motor drilling (FIG. 1*b*), although in recent years, a combination of both is often implemented in order to obtain the desired well path control.

During rotary drilling, the drilling assembly is rotated at surface by a drive system. This rotation is naturally transmitted to the drill bit at the bottom of the string. Drilling of the bore hole proceeds via the string weight as additional drill pipe is added. Mud motor drilling involves placing a mud motor/turbine at the bottom of the drilling/bottom hole assembly to which the drill bit is attached. During this process, drilling proceeds via mud flow within the assembly causing the centre shaft to rotate with the drill bit attached. During this process the drill string can remain stationary whilst drilling proceeds via the assembly weight.

Figure 1A:
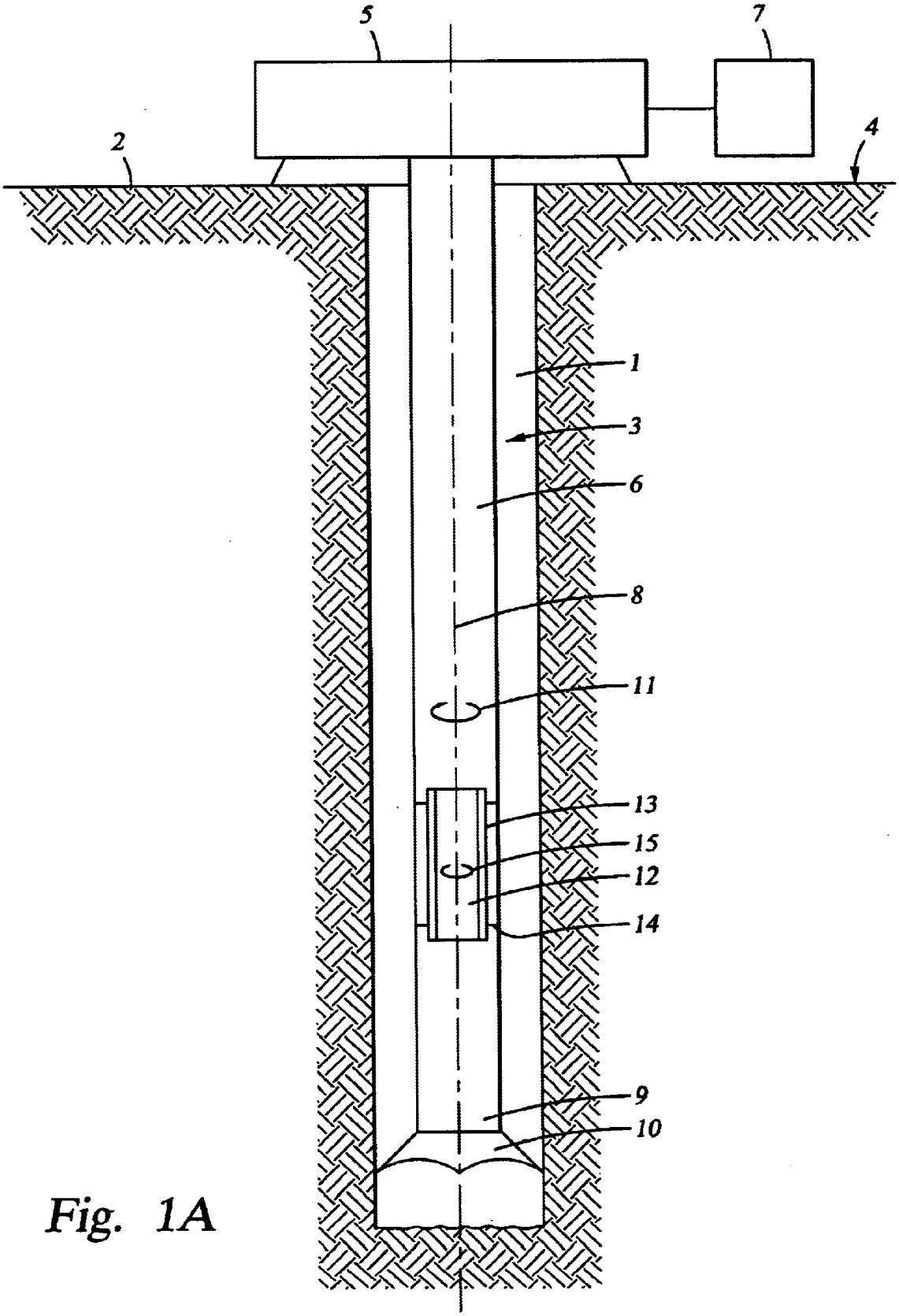
FIG. 1*a* illustrates a schematic section through a bore hole with one embodiment of apparatus according to the first aspect of the present invention inserted in the drill string for conventional rotary drilling.
Figure 1B:
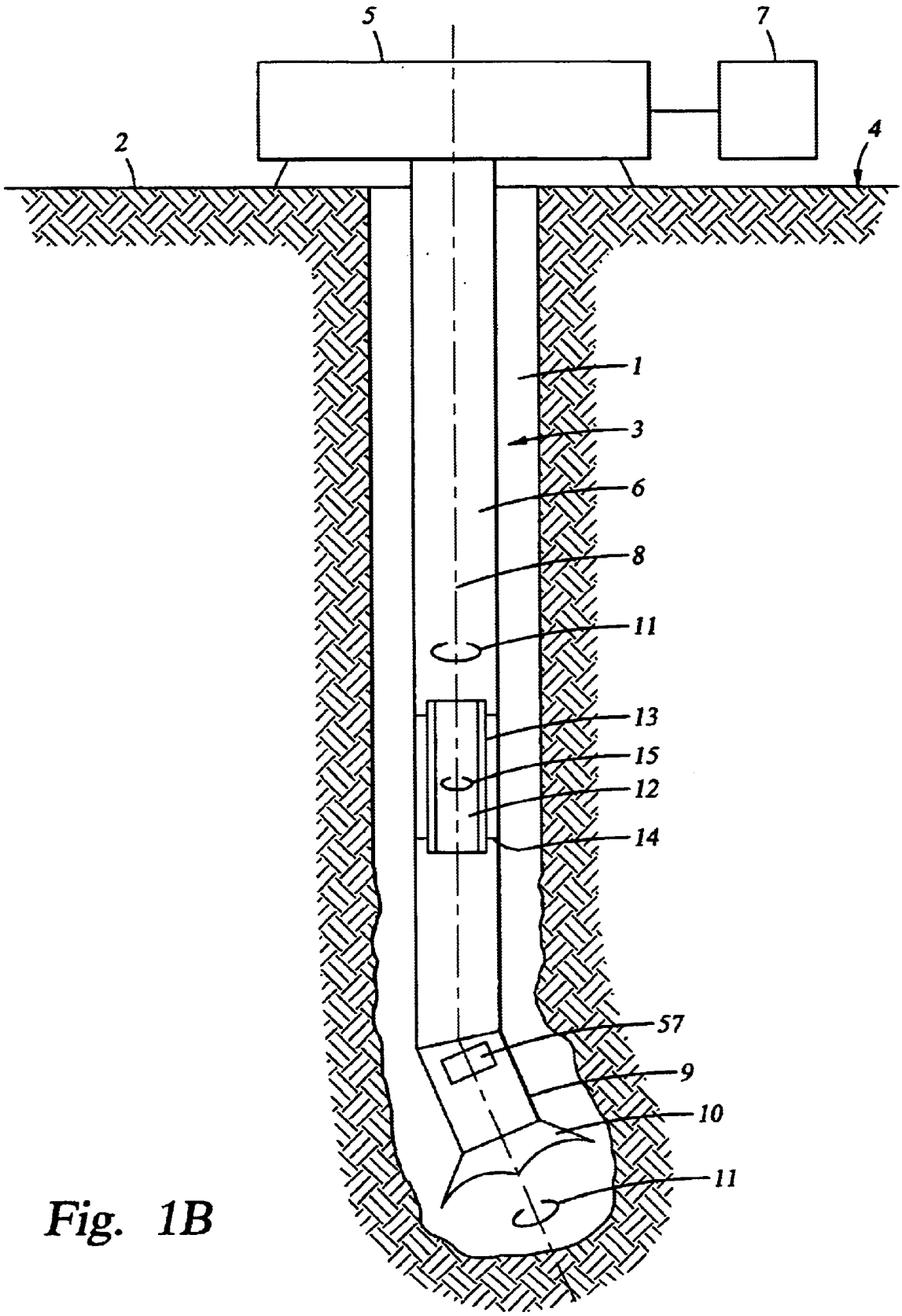
FIG. 1*b* illustrates a schematic section through a bore hole with another embodiment of apparatus according to the first aspect of the present invention inserted in the drill string for motor directional drilling.

FIG. 1*a* illustrates a longitudinal section through a bore hole 1 in the Earth 2 in which a bore drill string assembly 3 is inserted. At the surface 4, a drive system 5 and associated control unit 7 are depicted. The drive system 5 imparts rotary motion to a drill string 6 which extends along a drill string axis 8. At the lower end of the drill string 6 is located a bottom hole assembly containing a measurement unit 12 which is located within and rigidly attached to the bottom hole assembly. Below this is located a drill bit 10. FIG. 1*b* shows a similar arrangement but with the addition of a bent motor assembly 9 attached to the lower end of the bottom hole assembly.

During normal rotary drilling, the drill pipe can be rotated at up to 300 revolutions per minute to progress the bore hole along the planned well path. In this drilling mode, the measurement unit 12 is also subject to this rotation. For directional drilling, the planned deflection of the hole normally proceeds using a bent motor to maintain the deflected bottom hole assembly in the preferred direction as determined by the measuring unit 12. The degree of bore hole deflection can be limited and controlled by operating the drill pipe assembly in rotary mode to provide the desired bore hole position/displacement. During this process the drill string/bottom hole assembly rotation may vary from zero to 150 revolutions per minute.

The measuring unit 12 in its pressure case 16 is installed within, and rigidly attached to, the drill string 6 by webs 14.

Figure 2:
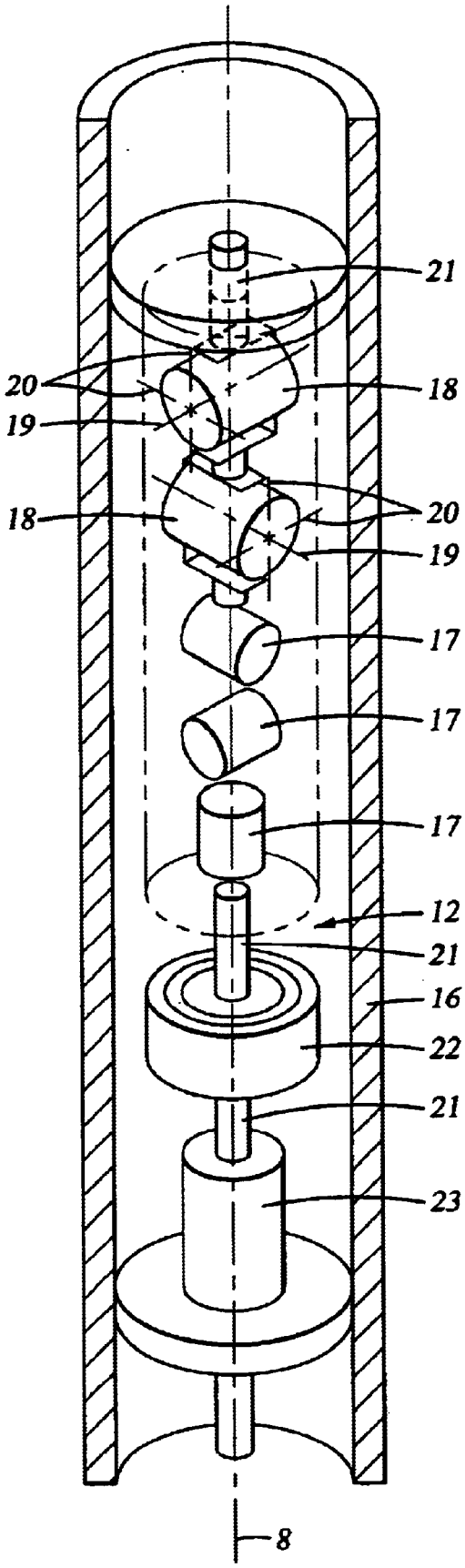
FIG. 2 is a longitudinal section through a measuring unit of the apparatus shown in FIGS. 1 and 2 illustrating the major elements of the measuring unit.

FIG. 2 illustrates the major components of the measuring unit 12. The measuring unit 12 is arranged within a cylindrical pressure case 16, which is located coaxial to the drill string axis 8. The measuring unit, in the particular embodiment of the invention shown here, comprises five inertial sensors; that is three translation movement sensors or accelerometers 17 and two dual-axis rotation sensors or gyroscopes 18. The accelerometers 17 are orientated in Cartesian coordinates, nominally coincident with the principle axes of the tool (the x, y and z directions), where the drill string axis 8 is coincident with the z-axis of the tool. The gyroscopes are mounted with their spin axes 19 mutually perpendicular to one another and to the drill string axis 8, and with their respective sensitive axes 20 coincident with the x, z and y, z axes of the tool respectively.

For the purposes of the ensuing description, the gyroscopes are assumed to be mechanical, spinning mass, sensors. In an alternative mechanisation of the system, three single axis gyroscopes could replace the two dual-axis gyroscopes. As an alternative to the mechanical sensors, the measuring unit could incorporate Coriolis vibratory gyroscopes such as the hemispherical resonator gyroscope, or optical gyroscopes such as the ring laser gyroscope or the fibre optic gyroscope.

As a further alternative to the system mechanisation described here and depicted in FIG. 2, the gyroscopes may be mounted with their sensitive axes rotated or skewed, at 45 degrees for example, with respect to the x, y, z axes of the tool.

The inertial sensors are installed on a cylindrical platform, which can be driven about the longitudinal axis of the tool, which is nominally coincident with the drill string axis 8, by means of a drive motor 22.

Furthermore, an angle detector or resolver 23 is incorporated to measure the angular rotation of the platform assembly 21, on which the inertial measurement unit 12 is mounted, relative to the case 16 of the tool.

Figure 3:
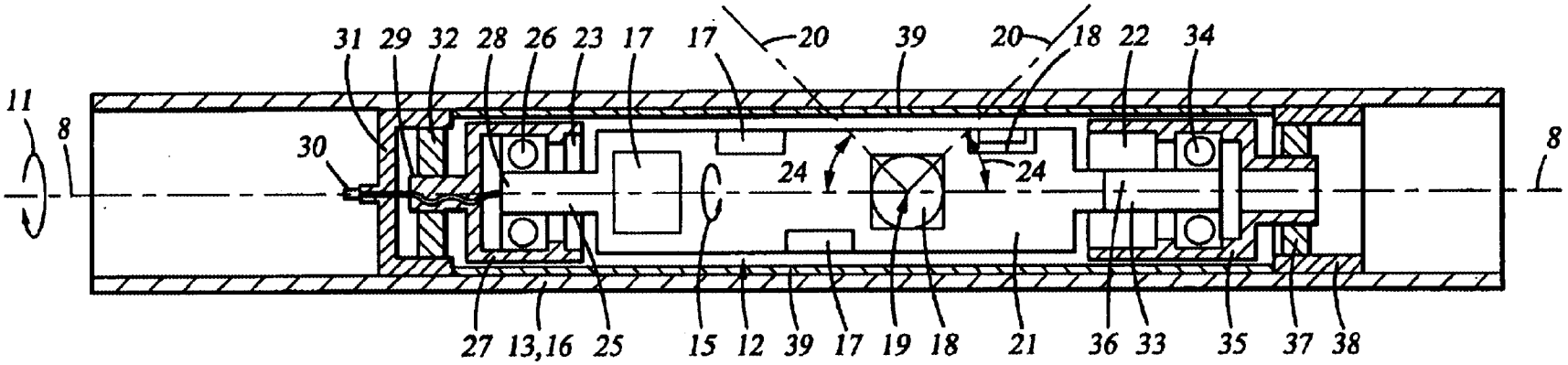
FIG. 3 is a detailed longitudinal section through the apparatus.

FIG. 3 shows a more detailed illustration of a longitudinal section of the measuring unit 12 in pressure case 16. In this figure, the gyroscopes are shown with their sensitive axes 20 at an angle of 45 degrees relative to the drill string axis 8, and their spin axes perpendicular to the drill string axis.

The shaft ends 25, 33 of the platform 21 of the measuring unit 12 are supported at either end by pre-loaded ball bearings 26 and 34 in a supporting flange. The bearing assemblies are held by a flange supports 27, 35 which are, in turn, attached via a shock mounts 32, 37 to further flange assemblies 31, 38 at each end of the platform. The assemblies 31, 38 are each attached rigidly to the case of the tool 16. The shock mounts 32, 37 are required to attenuate the shock and vibration applied externally to the tool when operating under drilling conditions in order to protect the inertial sensors on the platform.

At the lower shaft end, the end closest to the drill bit, the angle detector 23 is located coaxially to the shaft end 25. At the shaft at the top end of the platform, the end directed to the surface 4, the drive unit or motor 22 is located between the supporting flange 35 and the shaft end 33.

Slip rings assemblies 28, 36 are installed at either end of the platform to facilitate the tranission of electrical signals and power between the inertial sensors on the rotating platform assembly, and the fixed portion of the tool which houses the electronics assembly. The slip ring assembly at the top end of the platform allows signals to be passed between the sensors and the electronics assembly via an electrical conduit. The lower slip ring assembly allows signals to be passed between the resolver 23 at the lower end of the platform and the electronics assembly above the platform.

A cylindrical magnetic shield 39 is coaxially mounted around the measuring unit 12 between the said fixing flanges 31,38 and the case of the tool.

The ends of the pressure case 16 are sealed with covers.

Figure 4:
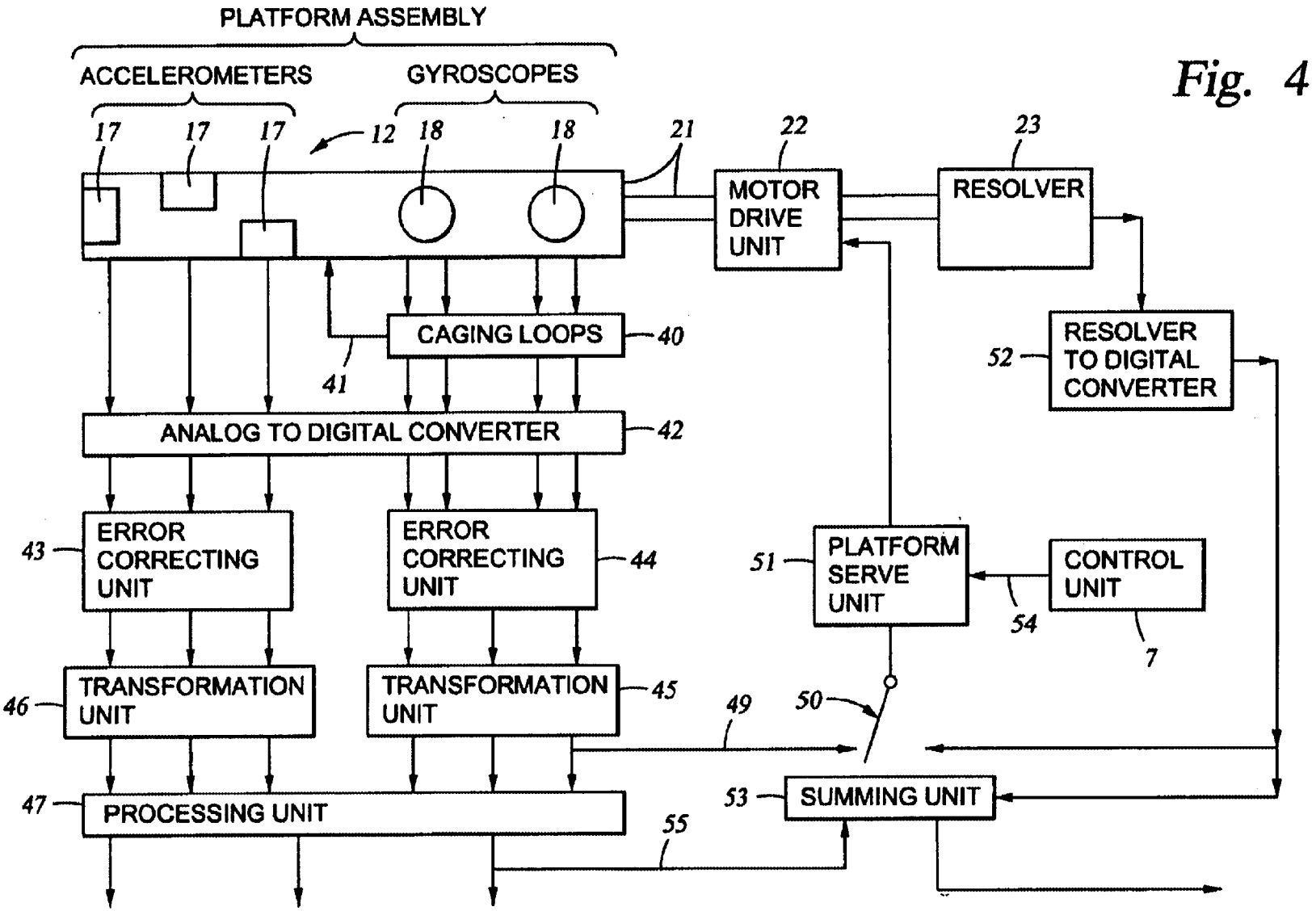
FIG. 4 is a block diagram illustrating one embodiment of a method according to the present invention.

FIG. 4 provides a schematic illustration showing one embodiment of the operation according to the present invention. The reference numbers used for each elements or component of the system are common to each of the figures allowing reference to be made to the preceding explanations where necessary.

The gyroscopes 18 used in the system described here are mechanical gyroscopes in which each sensor provides two signals to a measuring control unit 40. These signals correspond respectively to the rotation about each of the gyroscope sensitive axes. The control unit takes the form of a feedback system, referred to as gyroscope caging loop, which allow the gyroscopic measurements to be passed via suitable shaping networks to the appropriate torque motor so as to cause the gyroscope rotor to precess at the same rate as the turn rate of the sensor case in order to maintain the rotor at a null or 'caged' position. When operating in this mode, the current applied to each torque motor to achieve this null operating condition provides a measure of the turn rate of the gyroscope about each of its sensitive axes.

The gyroscopic measurements of angular rate are passed to an analogue to digital converter 42. Likewise, signals representing the translational movement of the tool in the Cartesian directions x, y and z are sent from the accelerometers 17 to the analogue to digital converter 42.

The digitised signals from the accelerometers 17 are passed to an error correcting unit 43 which compensates errors in these data which result from biases in the measurements, scale factor errors and temperature sensitivity of the devices. It also provides compensation for the fact that the accelerometers are not precisely mounted on the platform unit 21 with their sensitive axes orientated at 90 degrees to one another.

The digitised signals derived using the gyroscopes 18 operating in conjunction with their caging loops 40 are also passed to an error correcting unit 44 in which similar corrections are applied for measurement errors in the gyroscopes, including temperature compensations, and mounting misalignments associated with these sensors.

The compensated signals from units 43 and 44 are then passed to attitude transformation units 46 and 45. In the transformation units, the measured translations and rotation rates are each resolved in the direction of a Cartesian coordinate frame fixed in the platform, in which one of the axes is coincident with the axis of the tool string.

The signals produced by the transformation units 45, 46 are three translation signals in the x, y and z axes of the platform and three angular rates about the x, y and z axes of the platform. These signals are then passed to a processing unit 47 in which the strapdown computations are implemented; the calculation of the platform orientation with respect to an Earth fixed coordinate frame which may be specified in terms of the azimuth, inclination and roll, or high side angle, of the measuring unit 12. This information combined with well depth data can be used to calculate the accurate position of the measuring unit in the well bore with respect to an Earth fixed reference frame.

One signal from the transformation unit 45 represents the rotation rate of the tool about an axis coincident with the drill string axis 8 relative to platform fixed coordinates. This rotation rate 49 can be sent via a platform servo unit 51 to the platform drive unit 22 in order to control and stabilise the motion of the platform assembly.

Optionally, a fixed value 54 can be delivered from the control unit 7 to the servo unit 51 to enable the platform to be rotated at a fixed rate with respect to an Earth fixed frame corresponding to the desired set value 54.

The angle detector/resolver 23 associated with the moving platform senses the angular rotation of the rotating drill string 6 and delivers this signal to a resolver to digital converter 52, the output of which can be passed via a switch 50 to the platform servo unit 51.

Optionally, the rotation rate component 49 or the angular rotation relative to the drill string can be delivered to the platform servo unit 51 and the drive unit 22 can be controlled correspondingly as required.

The system also incorporates a summing unit 53 which sums an output of the strapdown processing unit 55, representing the roll angle of the platform, and the digitised resolver output from the resolver to digital converter unit 52 to generate a measure of the toolface angle.

The measuring unit 12 is located within the drill string 6, as close to the drill bit as possible. When operating under rotary drilling conditions (i.e. during drilling), the drill string rotates rapidly whilst drilling the well bore by means of the drill bit 10. This rotation rate can be up to 300 revolutions per minute relative to the Earth. Under these conditions, any rotation of the platform which occurs, as a result of sliding friction in the bearings which support the platform, will be detected by the gyroscopes giving rise to an output signal which is ultimately passed to the drive unit 22. The drive unit 22 causes the platform to rotate in the opposite sense to the applied rotation causing the measuring unit 12 to remain stationary relative to the Earth.

Alternatively, a set angular rate value 54 can be passed to the platform servo unit 52 by means of the control unit 7 to allow any desired continuous rotation rate of the measurement unit 12 with respect to the Earth to be maintained during the drilling or well survey process. During a slow rotation of the platform, any fixed errors in the measured angular rates provided by the gyroscopes could be calibrated, or the impact of the errors in the measured rates can be averaged in order to minimise their effect on the overall accuracy of the system. This is possible because the gyroscopes are rotating with respect to the Earth fixed reference frame in which the outputs of the system, the measurements of azimuth, inclination and high side angle, are referenced. The effects of the biases therefore act in different directions in three Earth fixed frame as the platform rotates.

By adopting these approaches, it is possible to control the direction of the well bore whilst drilling, even during a fast rotation of the drill string, as may be expected under rotary drilling conditions. By this approach, a measurement accuracy can be obtained which was not possible hitherto.

As a further alternative to the system operating modes described above, the rotation of the measuring unit 12 relative to the drill string 6 can be measured by the angle detector 23 allowing the angular position of the platform with respect to the case of the tool to be controlled. In this case, the angle detector output is passed to the drive unit 22 via the servo unit 51. This operating mode can be used to perform a calibration of the measuring unit prior to a drilling or well survey operation. By rotating the measuring unit on the platform to different orientations, it is possible to derive estimates of any residual gyroscope and accelerometer biases for example, and so compensate for their effects before the start of the drilling or well survey measurement process.

In a system of the type described here, attitude data is generated by performing a process of mathematical integration, with respect to time, of the measured angular rate signals generated by the gyroscopes. As with any integration, it is necessary to initialise this process by defining the initial attitude of the system. The process of establishing the initial orientation of the inertial measurement unit is referred to as system alignment, and may be achieved by a variety of methods. For example, a coarse estimate of system azimuth may be determined by the method of mechanical indexing in which the inertial measurement unit is rotated on the platform to different angular positions and measurements of the Earth's rate vector are taken in each position. By summing and differencing measurements taken 180 degrees apart, it is possible to offset the effect of a residual gyroscope bias and determine tool direction with respect to true north. Alternatively, such information may be provided by an external source and input to the system; a triad of magnetometers attached or adjacent to the tool would provide a measure of magnetic azimuth which could be corrected for magnetic declination to estimate direction with respect to true north. Given sufficient time, and given that the tool will be stationary at this stage of the operation, a more precise estimate of tool azimuth can be obtained by implementing a gyrocompassing procedure in line with standard practice for inertial systems of the type described here.

The design of the system in which the inertial sensors are decoupled from any high rates of rotation of the drill string and are protected by shock mounts, is substantially less susceptible to mechanical shocks and vibration than previous systems allowing a high accuracy of measurement to be maintained under drilling conditions. Further, the platform configuration described here avoids the risk of over-ranging gyroscopes through excessive rotations about tool string axis being applied accidentally, hence adding to the robustness of the system.

The apparatus above described can use a low performance control unit and still obtain accurate position, velocity and attitude data. This leads to the added advantage that low electrical power is required to operate the system as compared to known systems. This can be appreciated when it is considered that a conventional platform system relies upon the sensitive axes of the inertial sensors being maintained very accurately in a particular orientation leading to the requirement for a stiff, or high gain, feedback loop in order to satisfy typical performance criteria. No such requirement exists to achieve a similar level of performance with the system described herein. The platform mechanisation is implemented purely to decouple the gyroscopes from the high rates that will be experienced when operating under rotary drilling conditions. Since a residual low rate will not detract from the performance of the system, the tolerance on the platform feedback loop, and hence the power requirements, can be relaxed without compromising the performance of the system.

It will be appreciated that the invention described above may be modified.

What is claimed is:

1. Apparatus for determining the path of a well bore during drilling, comprising:

a drillstring disposed in the well bore, wherein said drillstring has a first rate of angular displacement about its longitudinal axis;

a platform assembly disposed within said drill string, wherein said platform assembly is only rotatable about the longitudinal axis of the drill string;

an inertial measurement unit comprising a plurality of inertial sensors mounted on said platform assembly and adapted to provide data from which position, velocity and attitude can be derived, and a drive unit for rotating the platform assembly about the longitudinal axis at a second rate of angular displacement so as to control the rate of angular displacement of the platform assembly with respect to only one axis of an Earth fixed reference frame.

2. Apparatus as claimed in claim 1, wherein the inertial sensors comprise accelerometers and gyroscopes and wherein the inertial measurement unit further includes means for integrating output signals of the accelerometers once to provide information representative of velocity and twice to provide information representative of position, and means responsive to output signals of the gyroscopes for resolving the accelerometer outputs into an Earth fixed reference frame and to generate estimates of inclination azimuth and tool face angles.

3. Apparatus as claimed in claim 2, further comprising a control unit responsive to the output of the gyroscopes for controlling the speed of the platform drive unit.

4. Apparatus as claimed in claim 2, wherein the inertial measurement unit comprises two dual-axis gyroscopes or three single axis gyroscopes.

5. Apparatus as claimed in claim 1 wherein the platform assembly is mounted within a casing for rotation relative thereto and wherein shock mounts are provided between the platform assembly and the casing.

6. Apparatus as claimed in claim 5, wherein the inertial measurement unit further comprises an angle detector or resolver for sensing the orientation of the platform assembly relative to the casing.

7. A method for determining the path of a wellbore during drilling comprising:

disposing an inertial measurement unit having accelerometers and gyroscopes mounted on a platform assembly disposed within a drill string rotating at a first angular displacement;

rotating the platform assembly with a drive unit at a second angular displacement so as to control the rate of angular displacement of the platform with respect to only one axis of an Earth fixed reference frame;

using the output signals of the gyroscopes to resolve output signals of accelerometers into the Earth fixed reference frame;

integrating resolved output signals of the accelerometers once to provide information representative of velocity;

integrating resolved output signals of the accelerometers twice to provide information representative of position; and generating estimates of inclination azimuth and tool face angles.

8. The method of claim 7 wherein the platform assembly is rotated to remain substantially stationary in angular terms with respect to the Earth fixed reference frame.

9. The method of claim 7 wherein the platform assembly is rotated at a fixed angular rate with respect to the Earth frame reference.

10. The method of claim 7 wherein the platform assembly is rotated by the drive unit at a slow angular rate relative to an Earth fixed reference frame to cancel out the effects of residual bias errors in the gyroscopes.

11. The method of claim 7 wherein the drive means is used to decouple and maintain control of rotation of the platform assembly relative to tool string rotation to reduce the effects of scale factor errors in the gyroscopes.

12. The method of claim 7 further comprising the step of calibrating the apparatus prior to commencement of a drilling operation.

13. An apparatus for determining the path of a wellbore during drilling, comprising:

a platform disposed within a drill string rotating about its longitudinal axis at a first angular velocity;

a means for providing data from which position, velocity, and attitude can be derived, wherein said means for providing data is mounted to said platform;

a means for rotating said platform at a second angular velocity in response to the rotation of the drill string so as to control the rate of angular displacement with respect to only one axis of an Earth fixed reference frame.

14. The apparatus of claim 13 further comprising a means for generating estimates of inclination azimuth and tool face angles.

15. The apparatus of claim 13 further comprising a means for sensing the orientation of said platform relative to the drill string.

* * * * *